United States Patent [19]

Stephens

[11] 4,417,487

[45] Nov. 29, 1983

[54] TOOL FOR CLEANING OR CHANGING MIG-CONTACT-TIPS

[76] Inventor: Vernon E. Stephens, 7422 Cherokee Dr., Downey, Calif. 90241

[21] Appl. No.: 339,392

[22] Filed: Jan. 15, 1982

[51] Int. Cl.[3] ..... B25B 13/50

[52] U.S. Cl. ..... 81/53.2; 15/104.04

[58] Field of Search ..... 81/53.2, 120; 15/104.04; 29/79

[56] References Cited

U.S. PATENT DOCUMENTS

| | | | |
|---|---|---|---|
| 348,185 | 8/1886 | Bowman | 81/53.2 |
| 906,040 | 12/1908 | Lucas | 81/120 |
| 1,224,801 | 5/1917 | Sprung | 81/53.2 |
| 1,913,606 | 6/1933 | McKenna | 15/104.04 |
| 3,188,674 | 6/1965 | Hobbs | 15/104.04 |
| 4,246,728 | 1/1981 | Leasher | 15/104.04 |

FOREIGN PATENT DOCUMENTS

| | | | |
|---|---|---|---|
| 921575 | 1/1947 | France | 81/53.2 |
| 936855 | 2/1948 | France | 81/53.2 |
| 979774 | 12/1950 | France | 81/53.2 |

*Primary Examiner*—James L. Jones, Jr.
*Attorney, Agent, or Firm*—Christie, Parker & Hale

[57] ABSTRACT

A tool for cleaning or changing contact tips is provided which avoids damaging the tips. The tool has a handle portion with a cylindrical bore therein and a rotatable member eccentrically mounted in an aperture in the side of the handle having teeth for adjustably engaging the side of the contact tip when a contact tip is inserted into the cylindrical bore. An annular insert is located in the outer end of the cylindrical bore having teeth for cleaning splatter from the contact tip. The cylindrical bore in the handle member may be offset from the center of the handle member to cause the handle member to provide eccentric movement when rotated about a contact tip.

2 Claims, 3 Drawing Figures

TOOL FOR CLEANING OR CHANGING MIG-CONTACT-TIPS

FIELD OF THE INVENTION

This invention relates to a tool for cleaning or changing MIG-contact tips which avoids damaging the tip and threads.

Contact tips are usually cleaned or changed with conventional hand tools, such as pliers. The contact tips are composed of a relatively soft metal such as copper, and the use of conventional hand tools of hardened steel to clean or change the tips tends to damage the tips and in some instances with the flow of gas through the MIG nozzles.

SUMMARY OF THE INVENTION

Those difficulties are overcome in the present invention by providing a tool specifically designed to perform the required functions for contact tips. The tool has a handle portion with a cylindrical bore therein and a rotatable member eccentrically mounted in an aperture in the side of the handle having teeth for adjustably engaging the side of the contact tip when a contact tip is inserted into the cylindrical bore. An annular insert is located in the outer end of the cylindrical bore having teeth for cleaning splatter from the contact tip.

Preferably the handle is of cylindrical shape and only an order of magnitude larger than a contact tip so that it provides limited leverage so as to avoid stripping the threads on the contact tip.

Preferably, the axis of the cylindrical bore is offset from the cylindrical axis of the handle member so that the handle member provides eccentric movement when it is rotated about a contact tip. The offset provides a slightly enlarged area in the handle member in which the rotatable member is mounted for added strength.

DESCRIPTION OF THE PREFERRED EMBODIMENT

Figure 1:
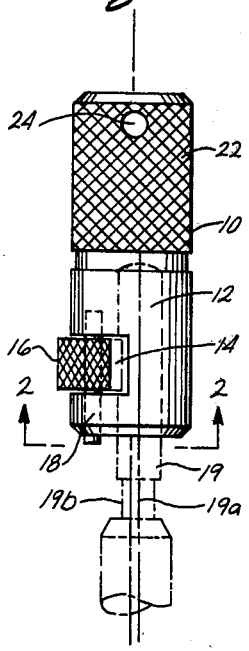
FIG. 1 is a side view of the tool showing in phantom a contact tip inserted therein.
Figure 2:
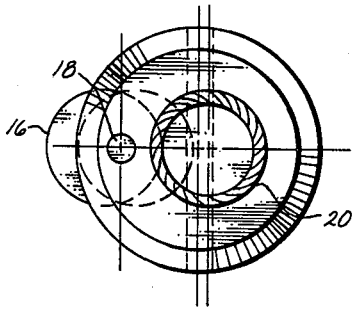
FIG. 2 is a view along line 2—2 of FIG. 1.
Figure 3:
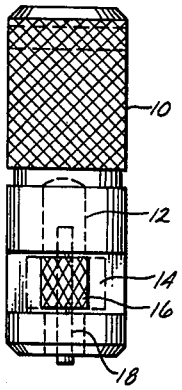
FIG. 3 is a front elevation view of the tool.

As illustrated in the three drawings, the tool comprises a handle member 10 of cylindrical shape having a cylindrical bore 12 in one end for receiving a contact tip. An aperture 14 in the handle member accommodates a rotatable member 16 that is eccentrically mounted on a shaft 18 that extends across the aperture 14. The rotatable member 16 is preferably of cylindrical shape and it has teeth for engaging the side of a contact tip 19 that may be inserted into the cylindrical bore 12. A conventional contact tip has a passageway 19*a* that exends longitudinally through the tip, and a threaded end 19*b* for coupling the tip to the source of power.

An annular insert 20 is concentrically located in the outer end of the cylindrical bore 12. The insert 20 has teeth for cleaning splatter from the side of the contact tip when a contact tip is inserted into the cylindrical bore 12.

Preferably, the handle member 10 is of cylindrical shape and only an order of magnitude larger than the cylindrical bore 12 so that the handle member provides limited leverage so as to avoid stripping the threads on the contact tip. The handle member may be knurled as illustrated at 22 to facilitate hand gripping of the tool, and it may have a transverse bore 24 for receiving a rod or tool when additional leverage is desired.

By way of example, the cylindrical bore may be 1-½" in length and 5/16" in diameter, the handle member may be 2-⅛" long and ¾" in diameter, and the rotatable member 16 may be ⅜" in length and ⅜" in diameter.

Preferably, the axis of the cylindrical bore 12 is offset from the cylindrical axis of the handle member 10 so that the handle member 10 provides eccentric movement when it is rotated about a contact tip to enhance the cleaning action. The offset also provides a slightly enlarged area in the handle member 10 in which the shaft 18 for the rotatable member 16 is mounted for added strength.

The eccentrically mounted rotatable member 16 permits the tool to accommodate contact tips of different sizes, yet it imparts a firm gripping action for either installing or removing a contact tip, all without damaging the relatively soft contact tips which are usually made of copper.

Preferably, the handle member 10 is composed of aluminum to provide light weight, and the rotatable member 16 and the insert 20 are composed of hardened steel.

In use, a contact tip may be cleaned by the rotating application of the teeth 20 to material, such as splatter, on the tip. In addition, the rotatable member 16 may be employed to provide some limited force and thereby effect additional cleaning action to the side of the contact tip if desired.

A contact tip may be gripped by the action of the rotatable member 16 for rotation of the tip in either direction, as required for the removal of a threaded tip from the contact apparatus, or the insertion of a threaded tip into the contact apparatus.

A tool of the same configuration can be made on the opposite end of the tool described herein for the changing of larger tips that are used in the MIG welding process.

What is claimed is:

1. A tool for cleaning or changing MIG contact tips comprising a handle member having a cylindrical bore therein and an aperture in a side wall communicating with the cylindrical bore, a shaft extending parallel with respect to the cylindrical bore and across the aperture, a rotatable member eccentrically mounted on the shaft and having teeth for adjustably engaging the side of the contact tip when a contact tip is inserted into the cylindrical bore, and an annular insert concentrically located in the outer end of the cylindrical bore having teeth for cleaning splatter from the side of the contact tip when a contact tip is inserted into the cylindrical bore, wherein the handle member is of cylindrical shape and wherein the axis of the cylindrical bore in the handle member is offset from the cylindrical axis of the handle member on the side opposite said shaft and the rotatable member, thereby causing the handle member to provide eccentric movement when the handle member is rotated about a contact tip.

2. The tool of claim 1 wherein the handle member is aluminum to provide light weight and the rotatable member and the insert are composed of hardened steel.

* * * * *